US009394634B2

(12) United States Patent
Agarwal

(10) Patent No.: US 9,394,634 B2
(45) Date of Patent: Jul. 19, 2016

(54) WOVEN SHIELDING TEXTILE IMPERVIOUS TO VISIBLE AND ULTRAVIOLET ELECTROMAGNETIC RADIATION

(71) Applicant: Arun Agarwal, Dallas, TX (US)

(72) Inventor: Arun Agarwal, Dallas, TX (US)

( * ) Notice: Subject to any disclaimer, the term of this patent is extended or adjusted under 35 U.S.C. 154(b) by 0 days.

(21) Appl. No.: 14/664,801

(22) Filed: Mar. 20, 2015

(65) Prior Publication Data

US 2015/0267324 A1 Sep. 24, 2015

Related U.S. Application Data

(60) Provisional application No. 61/968,356, filed on Mar. 20, 2014.

(51) Int. Cl.

| | |
|---|---|
| ***D03D 1/00*** | (2006.01) |
| ***D03D 15/00*** | (2006.01) |
| ***D03D 13/00*** | (2006.01) |
| *D03D 23/00* | (2006.01) |

(52) U.S. Cl.

CPC ..... *D03D 1/007* (2013.01); *D03D 13/00* (2013.01); *D03D 13/008* (2013.01); *Y10T 442/3203* (2015.04)

(58) Field of Classification Search

CPC ..... A41D 2400/26; A41D 31/00; A41D 2400/28; A41D 31/0011; A41D 31/0016; D03D 15/00; D03D 1/007; D03D 13/008; D03D 13/00; D03D 13/004; D03D 1/0058

See application file for complete search history.

(56) References Cited

U.S. PATENT DOCUMENTS

| | | | |
|---|---|---|---|
| 1,334,901 | A | 3/1920 | Higdon |
| 2,505,027 | A | 7/1946 | Belsky |
| 2,483,861 | A | 10/1949 | Weiss |
| 2,624,893 | A | 1/1953 | Harris |
| 2,662,234 | A | 12/1953 | Citron |
| 2,782,130 | A | 2/1957 | Ness et al. |
| 2,788,291 | A | 4/1957 | Stertz |

(Continued)

FOREIGN PATENT DOCUMENTS

| | | | |
|---|---|---|---|
| CA | 2155880 | A1 | 2/1997 |
| CA | 2346947 | A1 | 5/2000 |

(Continued)

OTHER PUBLICATIONS

"Woven Fabrics and Ultraviolet Protection", University of Maribor, Faculty of Mechanical Engineering, Slovenia on Aug. 18, 2010 by Polona Dobnik Dubrovski (pp. 25) http://cdn.intechopen.com/pdfs-wm/12251.pdf.

(Continued)

*Primary Examiner* — Bobby Muromoto, Jr.
(74) *Attorney, Agent, or Firm* — Raj Abhyanker, P.C.

(57) ABSTRACT

A woven shielding textile includes a set of weft yarns and a plurality of warp yarns, including a set of primary warp yarns and a set of secondary warp yarns. The set of primary warp yarns and the set of secondary warp yarns are selectively interlaced with the set of weft yarns using a double beam weaving system such that the woven shielding textile is warp-faced. A face surface is predominantly composed of the set of primary warp yarns and a back surface is predominantly composed of the set of secondary warp yarns, while the plurality of warp yarns alternates between the set of primary warp yarns and the set of secondary warp yarns. A substantial percent of light incident to the woven shielding textile does not pass through.

20 Claims, 6 Drawing Sheets

(56) References Cited

U.S. PATENT DOCUMENTS 2,942,280 A 6/1960 May, Jr.
2,963,715 A 12/1960 Young
2,971,095 A 2/1961 Drummond
3,027,573 A 4/1962 Bell, Jr.
3,081,197 A 3/1963 Adelman
3,144,666 A 8/1964 Clark et al.
3,265,527 A 8/1966 Adelman
3,441,063 A * 4/1969 Naimer ..... D03D 27/00 139/391
3,489,591 A * 1/1970 Cardarelli ..... C08K 3/22 250/516.1
3,536,920 A * 10/1970 Mavromatis ..... G21F 1/106 250/519.1
3,632,383 A 1/1972 Dominick et al.
3,694,832 A 10/1972 Jamison
3,721,274 A 3/1973 Sherrill et al.
3,774,250 A 11/1973 Miller
3,828,544 A 8/1974 Alker
4,042,986 A 8/1977 Goodman et al.
4,191,221 A 3/1980 Boyer
4,196,355 A 4/1980 Maine
4,279,045 A 7/1981 Vitale
4,338,693 A 7/1982 Vitale
4,352,380 A 10/1982 Owen
4,422,195 A 12/1983 Russo et al.
4,429,094 A 1/1984 Massucco
4,485,838 A 12/1984 Shoji et al.
4,496,619 A 1/1985 Okamoto
4,534,819 A 8/1985 Payet
4,546,493 A * 10/1985 Bortnick ..... A41D 7/00 139/420 R
4,578,306 A 3/1986 Heiman
4,621,489 A 11/1986 Okada
4,634,625 A 1/1987 Franklin
4,651,370 A 3/1987 Vitale
4,662,013 A 5/1987 Harrison
4,670,326 A 6/1987 Heiman
4,672,702 A 6/1987 Isham
4,682,379 A 7/1987 Dugan
4,703,530 A 11/1987 Gusman
4,724,183 A 2/1988 Heiman
4,727,608 A 3/1988 Joyce
4,734,947 A 4/1988 Vitale
4,742,788 A 5/1988 Dugan
4,777,677 A 10/1988 Dugan
4,802,251 A 2/1989 O'Dell
4,825,489 A 5/1989 Ross
4,839,934 A 6/1989 Rojas
4,861,651 A * 8/1989 Goldenhersh ..... D06M 13/127 427/160
4,896,406 A 1/1990 Weingarten et al.
4,903,361 A 2/1990 Tang
4,912,790 A 4/1990 MacDonald
4,962,546 A 10/1990 Vitale
4,962,554 A 10/1990 Tesch
4,980,564 A * 12/1990 Steelmon ..... G21F 1/125 174/388
4,980,941 A 1/1991 Johnson, III
4,985,953 A 1/1991 Seago et al.
5,010,610 A 4/1991 Ackley
5,010,723 A 4/1991 Wilen
5,020,177 A 6/1991 Etherington
5,029,353 A 7/1991 Kimball et al.
5,046,207 A 9/1991 Chamberlain
5,056,441 A 10/1991 Seago et al.
5,070,915 A 12/1991 Kalin
5,092,006 A 3/1992 Fogel
5,103,504 A * 4/1992 Dordevic ..... A41D 13/008 139/425 R
5,161,271 A 11/1992 Gronbach
5,191,777 A 3/1993 Schnegg
5,217,796 A 6/1993 Kasai et al.
5,249,322 A 10/1993 Seago
5,275,861 A 1/1994 Vaughn
5,285,542 A 2/1994 West et al.
5,287,574 A 2/1994 Kardell et al.
5,325,555 A 7/1994 Whitley
5,364,683 A 11/1994 Flint et al.
5,414,913 A * 5/1995 Hughes ..... A41D 31/00 26/29 P
5,465,760 A 11/1995 Mohamed et al.
5,487,936 A 1/1996 Collier
5,488,746 A 2/1996 Hudson
5,495,874 A 3/1996 Heiman
5,503,917 A * 4/1996 Hughes ..... A41D 31/00 139/383 R
5,530,979 A 7/1996 Whitley
5,531,985 A 7/1996 Mitchell et al.
5,542,137 A 8/1996 Byfield
5,625,912 A 5/1997 McCain et al.
5,628,062 A * 5/1997 Tseng ..... A41D 13/08 2/16
5,635,252 A 6/1997 Fraser, Jr. et al.
5,642,547 A 7/1997 Hutton et al.
5,729,847 A 3/1998 Allardice
5,765,241 A 6/1998 MacDonald
5,809,593 A 9/1998 Edwards
5,869,193 A 2/1999 Langley
5,884,349 A 3/1999 Gretsinger
5,906,004 A 5/1999 Lebby et al.
5,932,494 A 8/1999 Crippa
5,968,854 A * 10/1999 Akopian ..... A41D 31/0066 428/357
5,985,773 A 11/1999 Lee
5,996,148 A 12/1999 McCain et al.
6,025,284 A * 2/2000 Marco ..... D06M 13/352 428/409
6,034,003 A * 3/2000 Lee ..... D06M 13/123 442/130
6,037,280 A 3/2000 Edwards et al.
6,098,219 A 8/2000 Milber
6,148,871 A 11/2000 Hassell et al.
6,164,092 A 12/2000 Menaker
6,243,896 B1 6/2001 Osuna et al.
6,281,515 B1 8/2001 Demeo et al.
6,338,367 B1 1/2002 Khokar
6,353,947 B1 3/2002 McCain et al.
6,369,399 B1 4/2002 Smirnov
6,499,157 B1 12/2002 McCain et al.
6,610,395 B2 8/2003 Rohrbach et al.
6,823,544 B2 11/2004 Treece
6,934,985 B2 8/2005 Sanders
7,032,262 B2 4/2006 Creech
7,140,053 B1 11/2006 Mangano
7,143,790 B2 12/2006 Liao
7,181,790 B2 2/2007 Wirtz
7,325,263 B2 2/2008 Stribling
7,398,570 B2 7/2008 Seago
7,476,889 B2 1/2009 Demeo et al.
7,673,656 B2 3/2010 Heiman
7,726,348 B2 6/2010 Heiman
7,856,684 B2 12/2010 Robertson et al.
8,053,379 B2 11/2011 Tingle et al.
8,171,581 B2 5/2012 Agarwall
8,186,390 B2 5/2012 Krishnaswamy et al.
8,230,537 B2 7/2012 Stewart et al.
8,267,126 B2 9/2012 Rabin et al.
8,334,524 B2 12/2012 Demeo et al.
8,566,983 B2 10/2013 Monaco
8,624,212 B2 1/2014 Yang et al.
8,627,521 B2 1/2014 Rowson et al.
8,640,282 B2 2/2014 Maguire et al.
8,689,375 B2 4/2014 Stinchcomb
8,690,964 B2 4/2014 Kramer et al.
8,707,482 B1 4/2014 Ramthun
8,911,833 B2 12/2014 Medoff
2002/0088054 A1 7/2002 McCain et al.
2002/0174945 A1 11/2002 Fair
2003/0092339 A1 5/2003 Covelli
2003/0190853 A1 10/2003 Lovingood
2003/0194938 A1 10/2003 Efird et al.
2004/0031098 A1 2/2004 Hollander
2004/0040090 A1 3/2004 Wootten
2004/0055660 A1 3/2004 Heiman

(56) References Cited

U.S. PATENT DOCUMENTS

| | | | | |
|---|---|---|---|---|
| 2004/0067706 | A1* | 4/2004 | Woods | A41D 31/0011 442/131 |
| 2005/0039937 | A1* | 2/2005 | Yeh | H05K 9/0084 174/394 |
| 2005/0042960 | A1* | 2/2005 | Yeh | H05K 9/0088 442/131 |
| 2005/0070192 | A1 | 3/2005 | Lorenzotti et al. | |
| 2005/0095939 | A1 | 5/2005 | Heiman | |
| 2005/0109418 | A1 | 5/2005 | Liao | |
| 2006/0180229 | A1 | 8/2006 | Heiman | |
| 2007/0014967 | A1 | 1/2007 | Tingle et al. | |
| 2007/0202763 | A1 | 8/2007 | Shibaoka et al. | |
| 2008/0057813 | A1 | 3/2008 | Tingle et al. | |
| 2008/0096001 | A1 | 4/2008 | Emden et al. | |
| 2008/0124533 | A1 | 5/2008 | Bouckaert et al. | |
| 2009/0155601 | A1 | 6/2009 | Lavature et al. | |
| 2009/0260707 | A1 | 10/2009 | Aneja et al. | |
| 2010/0015874 | A1 | 1/2010 | Tingle et al. | |
| 2010/0107339 | A1 | 5/2010 | Stinchcomb | |
| 2012/0009405 | A1 | 1/2012 | Krishnaswamy et al. | |
| 2012/0047624 | A1 | 3/2012 | Hubsmith | |
| 2012/0157904 | A1 | 6/2012 | Stein | |
| 2012/0186687 | A1 | 7/2012 | Huffstickler et al. | |
| 2014/0109315 | A1 | 4/2014 | Lilienthal | |
| 2014/0123362 | A1 | 5/2014 | Seitz et al. | |
| 2014/0157575 | A1 | 6/2014 | Stinchcomb | |
| 2014/0166909 | A1 | 6/2014 | Onizawa | |
| 2014/0304922 | A1 | 10/2014 | Kramer et al. | |
| 2014/0310858 | A1 | 10/2014 | Kupiec | |
| 2014/0342970 | A1 | 11/2014 | Kramer et al. | |
| 2015/0026893 | A1 | 1/2015 | Garrett et al. | |
| 2015/0047736 | A1* | 2/2015 | Agarwal | A47G 9/0238 139/435.6 |
| 2015/0267324 | A1* | 9/2015 | Agarwal | D03D 1/007 139/383 R |
| 2015/0292231 | A1* | 10/2015 | Gardner | E04H 15/58 135/96 |
| 2015/0309229 | A1* | 10/2015 | Ren | G02B 5/282 359/360 |

FOREIGN PATENT DOCUMENTS

| | | | |
|---|---|---|---|
| CN | 1361315 | A | 7/2002 |
| CN | 101385091 | A | 3/2009 |
| CN | 202072865 | U | 12/2011 |
| CN | 203475074 | U | 3/2014 |
| CN | 103820902 | A | 5/2014 |
| EP | 0758692 | A1 | 2/1997 |
| EP | 0913518 | A1 | 5/1999 |
| EP | 1389645 | A2 | 2/2004 |
| EP | 1678358 | A1 | 7/2006 |
| EP | 1400616 | B1 | 2/2007 |
| WO | 02059407 | A1 | 8/2002 |
| WO | 2005045111 | A1 | 5/2005 |
| WO | 2006062495 | A1 | 6/2006 |
| WO | 2006069007 | A2 | 6/2006 |
| WO | 2007133177 | A2 | 11/2007 |
| WO | 2008042082 | A2 | 4/2008 |
| WO | 2009115622 | A1 | 9/2009 |

OTHER PUBLICATIONS

"Electromagnetic Shielding Fabrics", LessEMF.com website on Jul. 8, 2015 (pp. 19) http://www.lessemf.com/fabric.html.

"Ultraviolet (UV) Protection of Textiles: A Review", International Scientific Conference, Gabrovo on Nov. 19-20, 2010 by Mine Akgun et al. (pp. 11) http://www.singipedia.com/attachment.php?attachmentid=1907&d=1296035072.

"Textiles in Electromagnetic Radiation Protection", Journal of Safety Engineering, p-ISSN: 2325-0003 in 2013 by Subhankar Maity et al. (pp. 9) http://www.sapub.org/global/showpaperpdf.aspx?doi=10.5923/j.safety.20130202.01.

"UV Protection Textile Materials", AUTEX Research Journal, vol. 7, No. 1 in Mar. 2007 by D. Saravanan (pp. 10) http://www.autexrj.com/cms/zalaczone_pliki/6-07-1.pdf.

* cited by examiner

WARP WEIGHT 602

WEFT WEIGHT 604

TEXTILE WEIGHT 600

| Sr.No. | Construction | Weight | Sr.No. | Construction | Weight |
|---|---|---|---|---|---|
| 1 | 100 Denx300 DD/308x92 | 280 GSM | 28 | 70 Denx300 DD/336x114 | 280 GSM |
| 2 | 100 Denx300 DD/308x86 | 270 GSM | 29 | 70 Denx300 DD/336x102 | 260 GSM |
| 3 | 100 Denx300 DD/308x78 | 260 GSM | 30 | 70 Denx300 DD/336x85 | 235 GSM |
| 4 | 100 Denx300 DD/294x77 | 250 GSM | 31 | 70 Denx300 DD/336x74 | 220 GSM |
| 5 | 100 Denx300 DD/294x66 | 235 GSM | 32 | 70 Denx300 DD/294x72 | 200 GSM |
| 6 | 100 Denx300 DD/266x66 | 220 GSM | 33 | 70 Denx300 DD/294x78 | 210 GSM |
| 7 | 100 Denx300 DD/266x59 | 210 GSM | 34 | 70 Denx300 DD/294x72 | 200 GSM |
| 8 | 100 Denx300 DD/252x57 | 200 GSM | 35 | 70 Denx300 DD/294x64 | 190 GSM |
| | | | 36 | 70 Denx300 DD/266x64 | 180 GSM |
| 9 | 80 Denx300 DD/336x104 | 280 GSM | | | |
| 10 | 80 Denx300 DD/336x98 | 270 GSM | 37 | 60 Denx350 DD/336x108 | 280 GSM |
| 11 | 80 Denx300 DD/336x92 | 260 GSM | 38 | 60 Denx350 DD/336x96 | 260 GSM |
| 12 | 80 Denx300 DD/336x84 | 250 GSM | 39 | 60 Denx330 DD/336x86 | 235 GSM |
| 13 | 80 Denx300 DD/336x76 | 235 GSM | 40 | 60 Denx330 DD/336x78 | 220 GSM |
| 14 | 80 Denx300 DD/294x76 | 220 GSM | 41 | 60 Denx330 DD/294x78 | 210 GSM |
| 15 | 80 Denx300 DD/294x68 | 210 GSM | 42 | 60 Denx330 DD/294x73 | 200 GSM |
| 16 | 80 Denx300 DD/280x66 | 200 GSM | 43 | 60 Denx330 DD/266x72 | 190 GSM |
| 17 | 80 Denx300 DD/266x62 | 190 GSM | 44 | 60 Denx300 DD/266x66 | 180 GSM |
| 18 | 80 Denx300 DD/252x60 | 180 GSM | | | |
| | | | 45 | 50 Denx350 DD/336x118 | 280 GSM |
| 19 | 75 Denx300 DD/336x102 | 270 GSM | 46 | 50 Denx350 DD/336x106 | 260 GSM |
| 20 | 75 Denx300 DD/336x96 | 260 GSM | 47 | 50 Denx350 DD/336x100 | 250 GSM |
| 21 | 75 Denx300 DD/336x90 | 250 GSM | 48 | 50 Denx350 DD/336x91 | 235 GSM |
| 22 | 75 Denx300 DD/336x80 | 235 GSM | 49 | 50 Denx330 DD/336x88 | 220 GSM |
| 23 | 75 Denx300 DD/294x80 | 220 GSM | 50 | 50 Denx330 DD/336x81 | 210 GSM |
| 24 | 75 Denx300 DD/294x74 | 210 GSM | 51 | 50 Denx330 DD/294x82 | 200 GSM |
| 25 | 75 Denx300 DD/280x70 | 200 GSM | 52 | 50 Denx330 DD/294x75 | 190 GSM |
| 26 | 75 Denx300 DD/266x66 | 190 GSM | 53 | 50 Denx330 DD/294x69 | 180 GSM |
| 27 | 75 Denx300 DD/252x64 | 180 GSM | | | |

LINEAR DENSITY OF WARP YARNS 606

LINEAR DENSITY OF WEFT YARNS 606

CONSTRUCTION PARAMETER TABLE 650

FIGURE 6

WOVEN SHIELDING TEXTILE IMPERVIOUS TO VISIBLE AND ULTRAVIOLET ELECTROMAGNETIC RADIATION

CLAIMS OF PRIORITY

This patent application is a conversion non-provisional application and claims priority of the U.S. Provisional patent application No. 61/968,356, titled 'WOVEN SHIELDING TEXTILE IMPERVIOUS TO VISIBLE AND ULTRAVIOLET ELECTROMAGNETIC RADIATION AND METHOD' filed on Mar. 20, 2014.

FIELD OF TECHNOLOGY

This disclosure relates generally to textiles and, more particularly, to a method, a device and/or a system of a woven shielding textile impervious to visible and ultraviolet electromagnetic radiation.

BACKGROUND

Shielding electromagnetic radiation in the visible range and the ultraviolet range may be desirable to create a dark environment during daylight hours or to prevent ionizing radiation, such as what may occur at wavelengths below 400 nanometers, from damaging biological tissue and/or other oxidation-sensitive materials.

Visible light and ultraviolet radiation may primarily penetrate woven textiles by penetrating through a set of pores that exist between an interlacing of a set of weft yarns and a set of warp yarns that make up the fabric. Some visible and ultraviolet radiation may also pass directly through the yarns of the woven textile or pass by indirect diffraction through the textile. A method for creating a light-impervious textile-like material that forms a barrier against electromagnetic radiation breach may including coating one or both sides of a woven textile in synthetic polymer (e.g., a rubber or a plastic) to fill the pores between the interlacing. However, the addition of a light-blocking coating such as a synthetic polymer may substantially decrease desirable mechanical properties of a native state of the woven textile as well as decrease breathability.

A person or an organization may require complete darkness for several reasons. Hotels and/or hospitals may be subject to a set of regulations requiring curtains over windows of a room to create a "blackout" environment that is substantially lacking in visible light and/or UV radiation. Specifically, a person may wish to have darkness so that they can rest with greater ease, or may even be subject to medical conditions that require complete darkness (e.g., sensitivity to light). The person may also wish to prevent visible and/or UV light from entering a location to decrease the heat absorbed by that area and therefore possible save money and energy to cool the area.

Additionally, darkness may be required in deployed military settings such as a command tent that may be set up in a desert. The command tent may have a set of communications and control equipment, and a display screen associated with the communications and control equipment may be difficult to see in a bright environments. Additionally, an exposure to UV light penetrating small pores in a tent fabric may, after a prolonged period, give rise to sun burn or even skin cancer in personnel within the tent despite the inclination that one is in the "shade" of the tent.

The synthetic polymer coating used to increase resistance to visible and UV light penetration may lack aesthetic appeal and create undesirable physical properties. For example, a woven curtain inside a hotel room may be coated on one side by the synthetic polymer. The woven curtain may look aesthetically pleasing from the interior of the hotel room (being that the woven side faces the inside of the hotel room), but may not look aesthetically pleasing as seen from the exterior of the hotel through the windows of the hotel room. Additionally, adding the synthetic polymer may decease flexibility, causing limited application (e.g., cannot be comfortably employed as apparel). Adding the synthetic polymer may also decrease breathability, for example causing the command tent to rapidly heat up being that it may be employed in the desert.

SUMMARY

Disclosed are a method, a device and/or a system of a woven shielding textile impervious to visible and ultraviolet electromagnetic radiation. In one aspect, a woven shielding textile includes a set of weft yarns and a plurality of warp yarns including a set of primary warp yarns and a set of secondary warp yarns. The set of primary warp yarns and the set of secondary warp yarns are selectively interlaced with the set of weft yarns using a double beam weaving system such that the woven shielding textile is warp-faced. The set of primary warp yarns and the set of secondary warp yarns are selectively interlaced with the set of weft yarns such that a face surface is predominantly composed of the set of primary warp yarns and a back surface is predominantly composed of the set of secondary warp yarns. The set of primary warp yarns and the set of secondary warp yarns are selectively interlaced with the set of weft yarns such that the plurality of warp yarns alternates between the set of primary warp yarns and the set of secondary warp yarns. The set of primary warp yarns and the set of secondary warp yarns are selectively interlaced with the set of weft yarns such that 90 to 100 percent of a light incident on the woven shielding textile does not pass through.

The set of primary warp yarns and the set of secondary warp yarns may be selectively interlaced with the set of weft yarns such that a first warp yarn, belonging to the set of primary warp yarns, may float over six weft yarns before passing under a first weft yarn. A second warp yarn, belonging to the set of secondary warp yarns and adjacent to the first warp yarn, may float under six weft yarns before passing over a second weft yarn. The first weft yarn and the second weft yarn may be separated by three weft yarns. The set of primary warp yarns and the set of secondary warp yarns may be selectively interlaced with the set of weft yarns such that a third warp yarn, belonging to the set of primary warp yarns and adjacent to the second warp yarn, may float over six weft yarns before passing under a third weft yarn. The second weft yarn and the third weft yarn may be adjacent, and the third weft yarn may be one of the three weft yarns separating the first weft yarn and the second weft yarn.

A weaving pattern may be repeated such that the third weft yarn of a first pattern instance may be the first weft yarn of a second pattern instance. The woven shielding textile may weigh between 180 GSM and 280 GSM, the plurality of warp yarns may weigh between 50 denier and 100 denier and/or the set of weft yarns may weigh between 300 denier and 350 denier. The woven shielding textile may have a linear density of warp yarns between 250 yarns per inch and 336 yarns per inch and/or the woven shielding textile may have the linear density of weft yarns between 57 picks per inch and 118 picks per inch. The set of weft yarns may be dope dyed and/or the plurality of warp yarns may be overdyed. The set of weft yarns and/or the plurality of warp yarns may be continuous-filament polyester yarns having multiple filaments and/or the woven shielding textile may not include a light-blocking coating.

In another aspect, a woven shielding textile includes a set of weft yarns and a plurality of warp yarns including a set of primary warp yarns and a set of secondary warp yarns. The set of primary warp yarns and the set of secondary warp yarns are selectively interlaced with the set of weft yarns such that the woven shielding textile is warp-faced. The set of primary warp yarns and the set of secondary warp yarns are selectively interlaced with the set of weft yarns such that a face surface is predominantly composed of the set of primary warp yarns and a back surface is predominantly composed of the set of secondary warp yarns. The set of primary warp yarns and the set of secondary warp yarns are selectively interlaced with the set of weft yarns, such that the plurality of warp yarns alternates between the set of primary warp yarns and the set of secondary warp yarns. The set of primary warp yarns and the set of secondary warp yarns are selectively interlaced with the set of weft yarns such that 90 to 100 percent of a light incident on the woven shielding textile does not pass through, without relying upon a light-blocking coating.

In yet another aspect, a woven shielding textile includes a set of weft yarns and a plurality of warp yarns including a set of primary warp yarns and a set of secondary warp yarns. The set of primary warp yarns and the set of secondary warp yarns are selectively interlaced with the set of weft yarns using a double beam weaving system such that the woven shielding textile is warp-faced. The set of primary warp yarns and the set of secondary warp yarns are selectively interlaced with the set of weft yarns such that a face surface is predominantly composed of the set of primary warp yarns and a back surface is predominantly composed of the set of secondary warp yarns. The set of primary warp yarns and the set of secondary warp yarns are selectively interlaced with the set of weft yarns such that the plurality of warp yarns alternates between the set of primary warp yarns and the set of secondary warp yarns. The set of primary warp yarns and the set of secondary warp yarns are selectively interlaced with the set of weft yarns such that 90 to 100 percent of a light incident on the woven shielding textile does not pass through.

The set of primary warp yarns and the set of secondary warp yarns are selectively interlaced with the set of weft yarns such that a first warp yarn, belonging to the set of primary warp yarns, floats over six weft yarns before passing under a first weft yarn. The set of primary warp yarns and the set of secondary warp yarns are selectively interlaced with the set of weft yarns such that a second warp yarn, belonging to the set of secondary warp yarns and adjacent to the first warp yarn, floats under six weft yarns before passing over a second weft yarn. The set of primary warp yarns and the set of secondary warp yarns are selectively interlaced with the set of weft yarns such that the first weft yarn and the second weft yarn are separated by three weft yarns. The set of primary warp yarns and the set of secondary warp yarns are selectively interlaced with the set of weft yarns such that a third warp yarn, belonging to the set of primary warp yarns and adjacent to the second warp yarn, floats over six weft yarns before passing under a third weft yarn, The set of primary warp yarns and the set of secondary warp yarns are selectively interlaced with the set of weft yarns such that the second weft yarn and the third weft yarn are adjacent. The set of primary warp yarns and the set of secondary warp yarns are selectively interlaced with the set of weft yarns such that the third weft yarn is one of the three weft yarns separating the first weft yarn and the second weft yarn.

The methods and systems disclosed herein may be implemented in any means for achieving various aspects, and may be executed in a form of a non-transitory machine-readable medium embodying a set of instructions that, when executed by a machine, cause the machine to perform any of the operations disclosed herein. Other features will be apparent from the accompanying drawings and from the detailed description that follows.

BRIEF DESCRIPTION OF THE DRAWINGS

The embodiments of this invention are illustrated by way of example and not limitation in the Figures of the accompanying drawings, in which like references indicate similar elements and in which:

FIG. 6 is a construction parameter table describing the woven shielding textile of FIG. 1, according to various embodiments.

Figure 1:
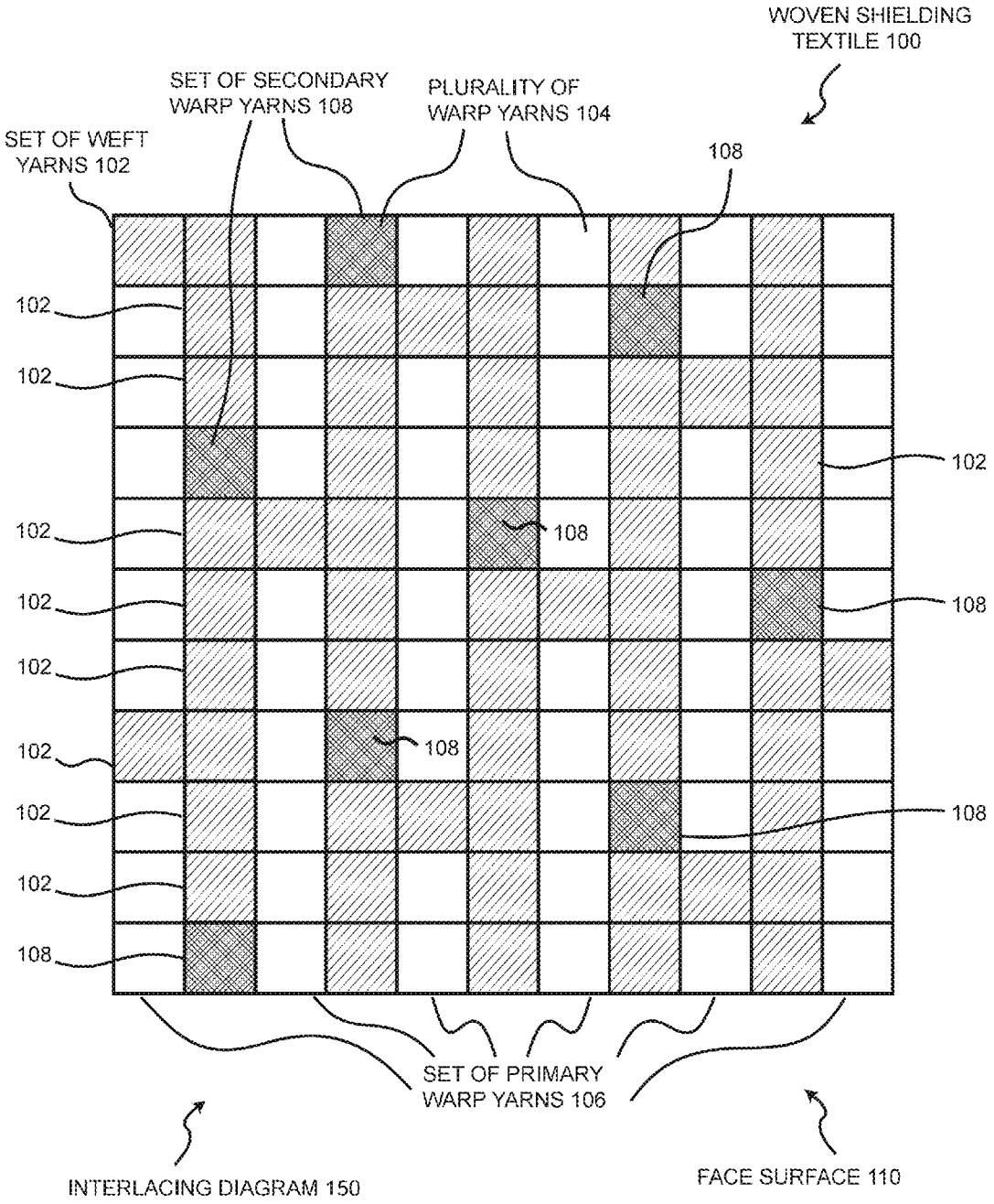
FIG. 1 is an interlacing diagram showing a face surface of a woven shielding textile, according to one embodiment.

Other features of the present embodiments will be apparent from the accompanying drawings and from the detailed description that follows.

DETAILED DESCRIPTION

Example embodiments, as described below, may be used to provide a method, a device and/or a system of a woven shielding textile impervious to visible and ultraviolet electromagnetic radiation.

In one embodiment, a woven shielding textile 100 includes a set of weft yarns 102 and a plurality of warp yarns 104 including a set of primary warp yarns 106 and a set of secondary warp yarns 108. The set of primary warp yarns 106 and the set of secondary warp yarns 108 are selectively interlaced with the set of weft yarns 102 using a double beam weaving system such that the woven shielding textile 100 is warp-faced. The set of primary warp yarns 106 and the set of secondary warp yarns 108 are selectively interlaced with the set of weft yarns 102 such that a face surface 110 is predominantly composed of the set of primary warp yarns 106 and a back surface 200 is predominantly composed of the set of secondary warp yarns 108. The set of primary warp yarns 106 and the set of secondary warp yarns 108 are selectively interlaced with the set of weft yarns 102 such that the plurality of warp yarns 104 alternates between the set of primary warp yarns 106 and the set of secondary warp yarns 108. The set of primary warp yarns 106 and the set of secondary warp yarns 108 are selectively interlaced with the set of weft yarns 102 such that 90 to 100 percent of a light 500 incident on the woven shielding textile 100 does not pass through.

The set of primary warp yarns 106 and the set of secondary warp yarns 108 may be selectively interlaced with the set of weft yarns 102 such that a first warp yarn 302, belonging to the set of primary warp yarns 106, may float over six weft yarns before passing under a first weft yarn 304. A second warp yarn 306, belonging to the set of secondary warp yarns 108 and adjacent to the first warp yarn 302, may float under six weft yarns before passing over a second weft yarn 308. The first weft yarn 304 and the second weft yarn 308 may be separated by three weft yarns. The set of primary warp yarns 106 and the set of secondary warp yarns 108 may be selectively interlaced with the set of weft yarns 102 such that a third warp yarn 310, belonging to the set of primary warp yarns 106 and adjacent to the second warp yarn 306, may float over six weft yarns before passing under a third weft yarn 312. The second weft yarn 308 and the third weft yarn 312 may be adjacent, and the third weft yarn 312 may be one of the three weft yarns separating the first weft yarn 304 and the second weft yarn 308.

A weaving pattern 300 may be repeated such that the third weft yarn 312 of a first pattern instance 402 may be the first weft yarn 304 of a second pattern instance 404. The woven shielding textile 100 may weigh between 180 GSM and 280 GSM, the plurality of warp yarns 104 may weigh between 50 denier and 100 denier and/or the set of weft yarns 102 may weigh between 300 denier and 350 denier. The woven shielding textile 100 may have a linear density of warp yarns between 250 yarns per inch and 336 yarns per inch and/or the woven shielding textile 100 may have the linear density of weft yarns between 57 picks per inch and 118 picks per inch. The set of weft yarns 102 may be dope dyed and/or the plurality of warp yarns 104 may be overdyed. The set of weft yarns 102 and/or the plurality of warp yarns 104 may be continuous-filament polyester yarns having multiple filaments and/or the woven shielding textile 100 may not include a light-blocking coating.

In another embodiment, a woven shielding textile 100 includes a set of weft yarns 102 and a plurality of warp yarns 104 including a set of primary warp yarns 106 and a set of secondary warp yarns 108. The set of primary warp yarns 106 and the set of secondary warp yarns 108 are selectively interlaced with the set of weft yarns 102 such that the woven shielding textile 100 is warp-faced. The set of primary warp yarns 106 and the set of secondary warp yarns 108 are selectively interlaced with the set of weft yarns 102 such that a face surface 110 is predominantly composed of the set of primary warp yarns 106 and a back surface 200 is predominantly composed of the set of secondary warp yarns 108. The set of primary warp yarns 106 and the set of secondary warp yarns 108 are selectively interlaced with the set of weft yarns 102, such that the plurality of warp yarns 104 alternates between the set of primary warp yarns 106 and the set of secondary warp yarns 108. The set of primary warp yarns 106 and the set of secondary warp yarns 108 are selectively interlaced with the set of weft yarns 102 such that 90 to 100 percent of a light 500 incident on the woven shielding textile 100 does not pass through, without relying upon a light-blocking coating.

In yet another embodiment, a woven shielding textile 100 includes a set of weft yarns 102 and a plurality of warp yarns 104 including a set of primary warp yarns 106 and a set of secondary warp yarns 108. The set of primary warp yarns 106 and the set of secondary warp yarns 108 are selectively interlaced with the set of weft yarns 102 using a double beam weaving system such that the woven shielding textile 100 is warp-faced. The set of primary warp yarns 106 and the set of secondary warp yarns 108 are selectively interlaced with the set of weft yarns 102 such that a face surface 110 is predominantly composed of the set of primary warp yarns 106 and a back surface 200 is predominantly composed of the set of secondary warp yarns 108. The set of primary warp yarns 106 and the set of secondary warp yarns 108 are selectively interlaced with the set of weft yarns 102 such that the plurality of warp yarns 104 alternates between the set of primary warp yarns 106 and the set of secondary warp yarns 108. The set of primary warp yarns 106 and the set of secondary warp yarns 108 are selectively interlaced with the set of weft yarns 102 such that 90 to 100 percent of a light 500 incident on the woven shielding textile 100 does not pass through.

The set of primary warp yarns 106 and the set of secondary warp yarns 108 are selectively interlaced with the set of weft yarns 102 such that a first warp yarn 302, belonging to the set of primary warp yarns 106, floats over six weft yarns before passing under a first weft yarn 304. The set of primary warp yarns 106 and the set of secondary warp yarns 108 are selectively interlaced with the set of weft yarns 102 such that a second warp yarn 306, belonging to the set of secondary warp yarns 108 and adjacent to the first warp yarn 302, floats under six weft yarns before passing over a second weft yarn 308. The set of primary warp yarns 106 and the set of secondary warp yarns 108 are selectively interlaced with the set of weft yarns 102 such that the first weft yarn 304 and the second weft yarn 308 are separated by three weft yarns. The set of primary warp yarns 106 and the set of secondary warp yarns 108 are selectively interlaced with the set of weft yarns 102 such that a third warp yarn 310, belonging to the set of primary warp yarns 106 and adjacent to the second warp yarn 306, floats over six weft yarns before passing under a third weft yarn 312, The set of primary warp yarns 106 and the set of secondary warp yarns 108 are selectively interlaced with the set of weft yarns 102 such that the second weft yarn 308 and the third weft yarn 312 are adjacent. The set of primary warp yarns 106 and the set of secondary warp yarns 108 are selectively interlaced with the set of weft yarns 102 such that the third weft yarn 312 is one of the three weft yarns separating the first weft yarn 304 and the second weft yarn 308.

FIG. 1 is an interlacing diagram 150 showing a face surface 110 of a woven shielding textile 100, according to one embodiment. Particularly, FIG. 1 shows a woven shielding textile 100, a set of weft yarns 102, a plurality of warp yarns 104, a set of primary warp yarns 106, a set of secondary warp yarns 108, and a face surface 110, according to one embodiment.

The woven shielding textile 100 may be a textile which is a substantially impervious barrier to light 500, particularly electromagnetic radiation in the visible and/or ultraviolet electromagnetic radiation bands. According to one embodiment, the woven shielding textile 100 is made of a set of yarns that are interlaced by a loom apparatus. The loom apparatus may be, for example, an air jet loom (e.g., a Picanol Omni Plus®, a Picanol Omni Plus® 800), a loom with a rapier loom, etc. In various embodiments, the woven shielding textile 100 may be described as a woven multi layer fabric, the surfaces of which are primarily comprised of warp yarns (e.g., on both the face and the back). Such a textile would be described as "warp faced". In the context of the present description, the face surface 110 refers to one side of the woven shielding textile 100.

The set of weft yarns 102 may be the crosswise yarns on a loom over and under which other yarns (e.g. warp yarns, etc.) are passed to make a textile. In the context of the present description, a yarn may refer to a spun thread suitable for the production of textiles. The set of weft yarns 102 may also be referred to as "picks."

The plurality of warp yarns 104 may be a collection of yarns that run lengthwise on a loom which are interwoven with weft yarns to form a textile. In various embodiments, the plurality of warp yarns 104 may be divided into two sets: the set of primary warp yarns 106, and the set of secondary warp yarns 108. In one embodiment, the primary and secondary warp yarns may be substantially identical. In another embodiment, the primary and secondary warp yarns may differ from each other in aspects which may include, but are not limited to, weight, color, and/or material. In various embodiments, the weft yarns and/or the warp yarns may be thermoplastic yarns. In one preferred embodiment, the thermoplastic may be continuous-filament polyester having multiple filaments.

As shown in FIG. 1, the set of primary warp yarns 106 and the set of secondary warp yarns 108 are selectively interlaced with the set of weft yarns 102 to form the woven shielding textile 100. FIG. 1 is showing the face surface 110 of the textile, which is predominantly composed of the set of primary warp yarns 106.

Figure 2:
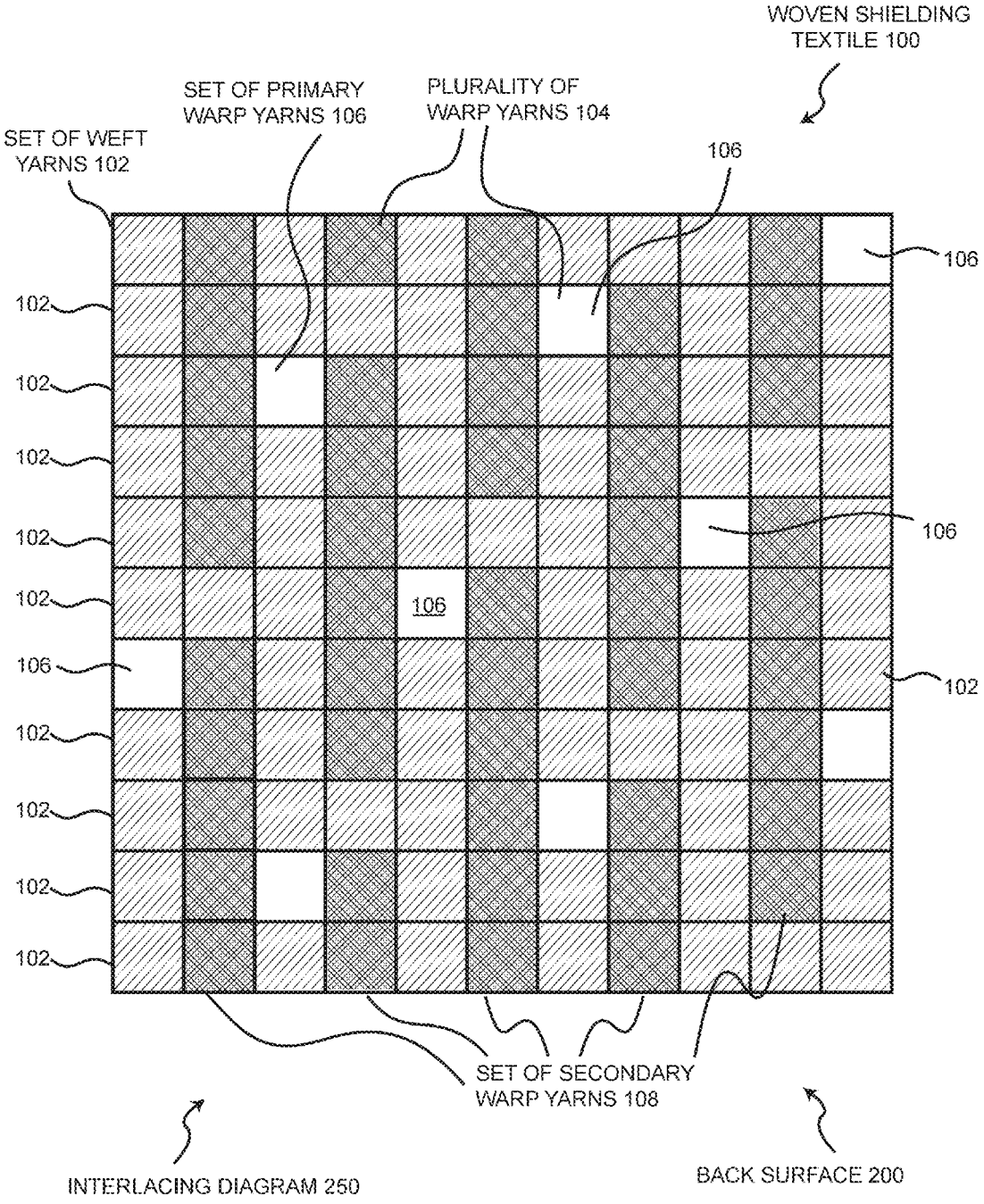
FIG. 2 is an interlacing diagram of a back surface of the woven shielding textile of FIG. 1, according to one embodiment.

FIG. 2 is an interlacing diagram 250 of a back surface 200 of the woven shielding textile 100 of FIG. 1, according to one embodiment. Particularly, FIG. 2 illustrates a back surface 200 of the woven shielding textile 100 of FIG. 1, in addition to the set of weft yarns 102, the plurality of warp yarns 104, the set of primary warp yarns 106, and the set of secondary warp yarns 108 of FIG. 1, according to one embodiment.

In the context of the present description, the back surface 200 refers to the side of the woven shielding textile 100 which is opposite the face surface 110. Similar to the interlacing diagram 150 of FIG. 1, FIG. 2 illustrates the selective interlacing of the plurality of warp yarns 104 with the set of weft yarns 102. FIG. 2 is showing the back surface 200 of the woven shielding textile 100, which is predominantly composed of the set of secondary warp yarns 108, in accordance with one embodiment.

Figure 3:
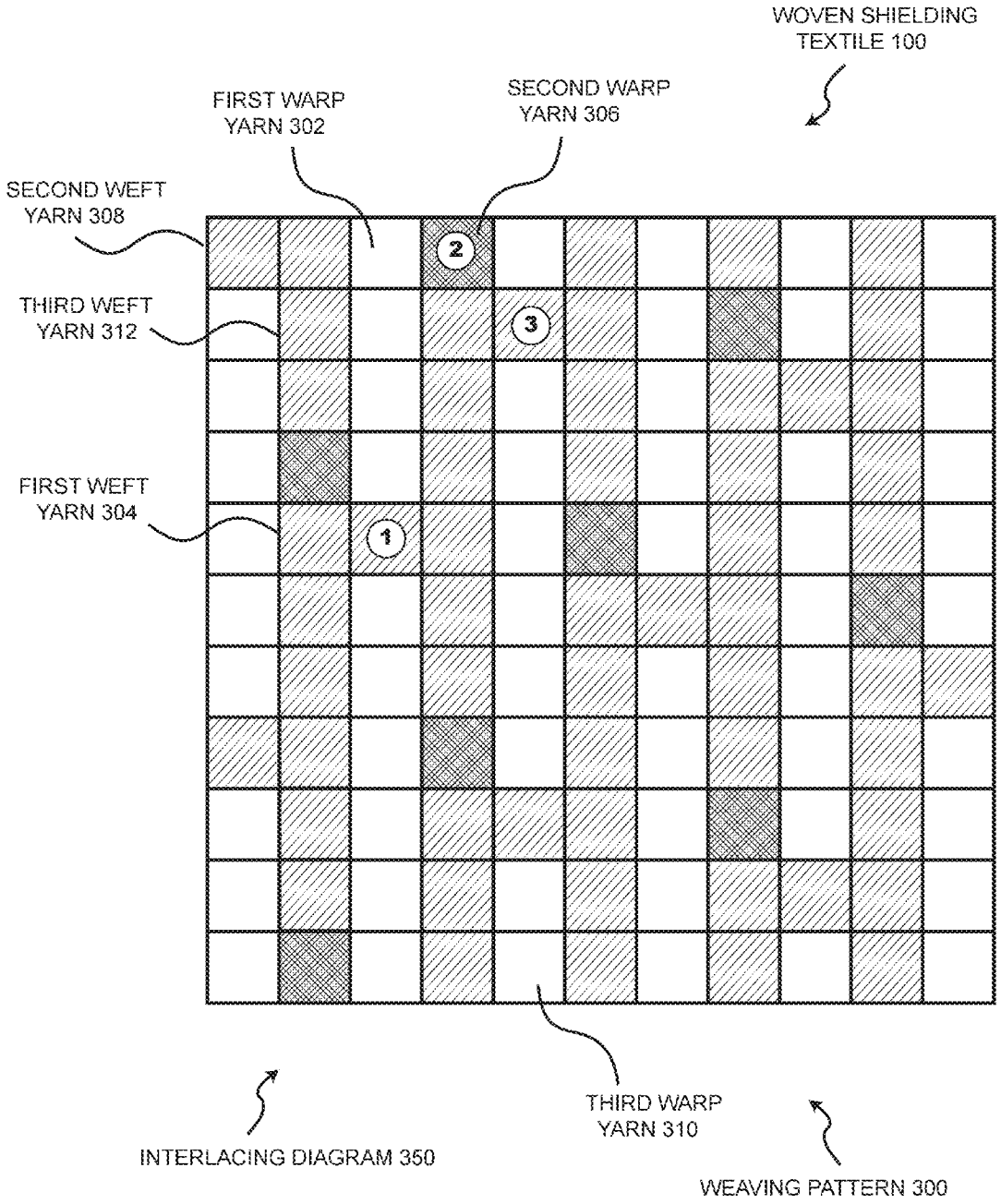
FIG. 3 is an interlacing diagram showing a weaving pattern in the face surface of FIG. 1, according to one embodiment.

FIG. 3 is an interlacing diagram 350 showing a weaving pattern 300 in the face surface 110 of FIG. 1, according to one embodiment. Particularly, FIG. 3 shows a weaving pattern 300, a first warp yarn 302, a first weft yarn 304, a second warp yarn 306, a second weft yarn 308, a third warp yarn 310, and a third weft yarn 312, all within the context of the woven shielding textile 100 of FIG. 1, according to one embodiment.

The weaving pattern 300 may be a repeated design formed by the selective interlacing of warp yarns and weft yarns. The first warp yarn 302, the second warp yarn 306, and the third warp yarn 310 may refer to specific warp yarns within a weaving pattern, whose relative position defines, at least in part, the repeated design. In various embodiments, the first warp yarn 302 and the third warp yarn 310 may belong to the set of primary warp yarns 106, while the second warp yarn 306 belongs to the set of secondary warp yarns 108.

The first weft yarn 304, the second weft yarn 308, and the third weft yarn 312 may refer to specific weft yarns within a weaving pattern, whose relative position defines, at least in part, the repeated design.

The weaving pattern 300 illustrated in FIG. 3 is defined by the interlacing of weft and warp, and represents a preferred embodiment. As shown, the first warp yarn 302, which belongs to the set of primary warp yarns 106, floats over six weft yarns before passing under the first weft yarn 304 in circle '1'. The second warp yarn 306, belonging to the set of secondary warp yarns 108, floats under six weft yarns before passing over the second weft yarn 308 at circle '2'. As shown, the first weft yarn 304 and second weft yarn 308 are separated by three weft yarns. A third warp yarn 310, belonging to the set of primary warp yarns 106, floats over six weft yarns before passing under the third weft yarn 312 at circle '3'. The second weft yarn 308 and the third weft yarn 312 are adjacent, and the third weft yarn 312 is one of the three weft yarns between the first and second weft yarns.

Similar weaving patterns may be used in other embodiments, which slightly differ from that illustrated in FIG. 3. For example, the warp yarns may float over/under more or less than 6 weft yarns. While the pattern shown in FIG. 3 represents a preferred embodiment, similar benefits may be obtained through slight variations, while also varying other properties such as appearance, texture, and flexibility.

Figure 4:
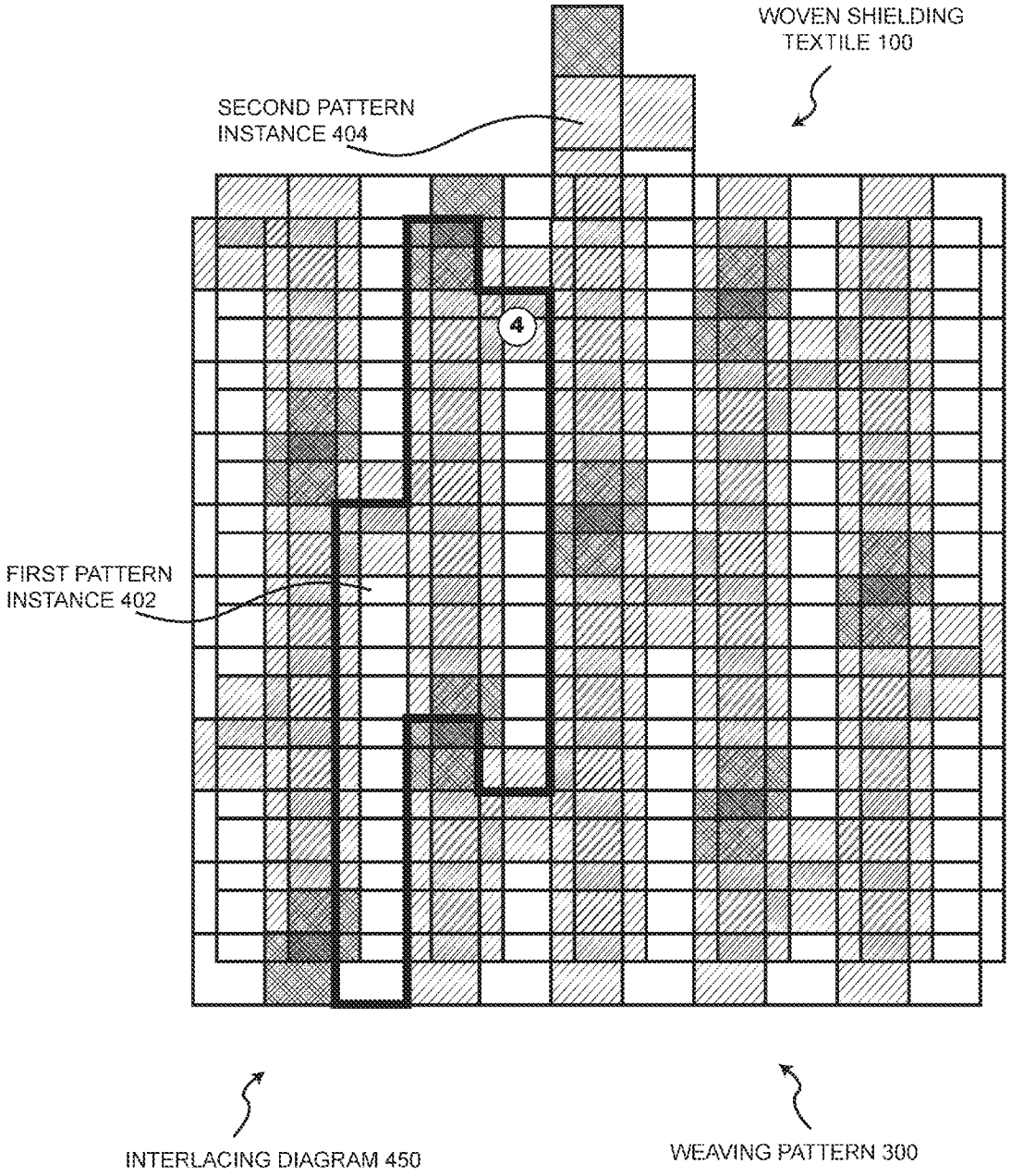
FIG. 4 is an interlacing diagram showing multiple pattern instances of the weaving pattern of FIG. 3, according to one embodiment.

FIG. 4 is an interlacing diagram 450 showing multiple pattern instances of the weaving pattern 300 of FIG. 3, according to one embodiment. Particularly, FIG. 4 shows a first pattern instance 402, and a second pattern instance 404, as well as the weaving pattern 300 of FIG. 3 in the context of the woven shielding textile 100 of FIG. 1, according to one embodiment.

The first pattern instance 402 may be a single instance of a repeating design created by a weaving pattern. The second pattern instance 404 may refer to a single instance of a weaving pattern 300 which overlaps, at least in part, with the first pattern instance 402, according to one embodiment. In FIG. 4, the first pattern instance 402 and the second pattern instance 404 overlap at circle '4', such that the third weft yarn 312 of the first pattern instance 402 is also the first weft yarn 304 of the second pattern instance 404.

Figure 5:
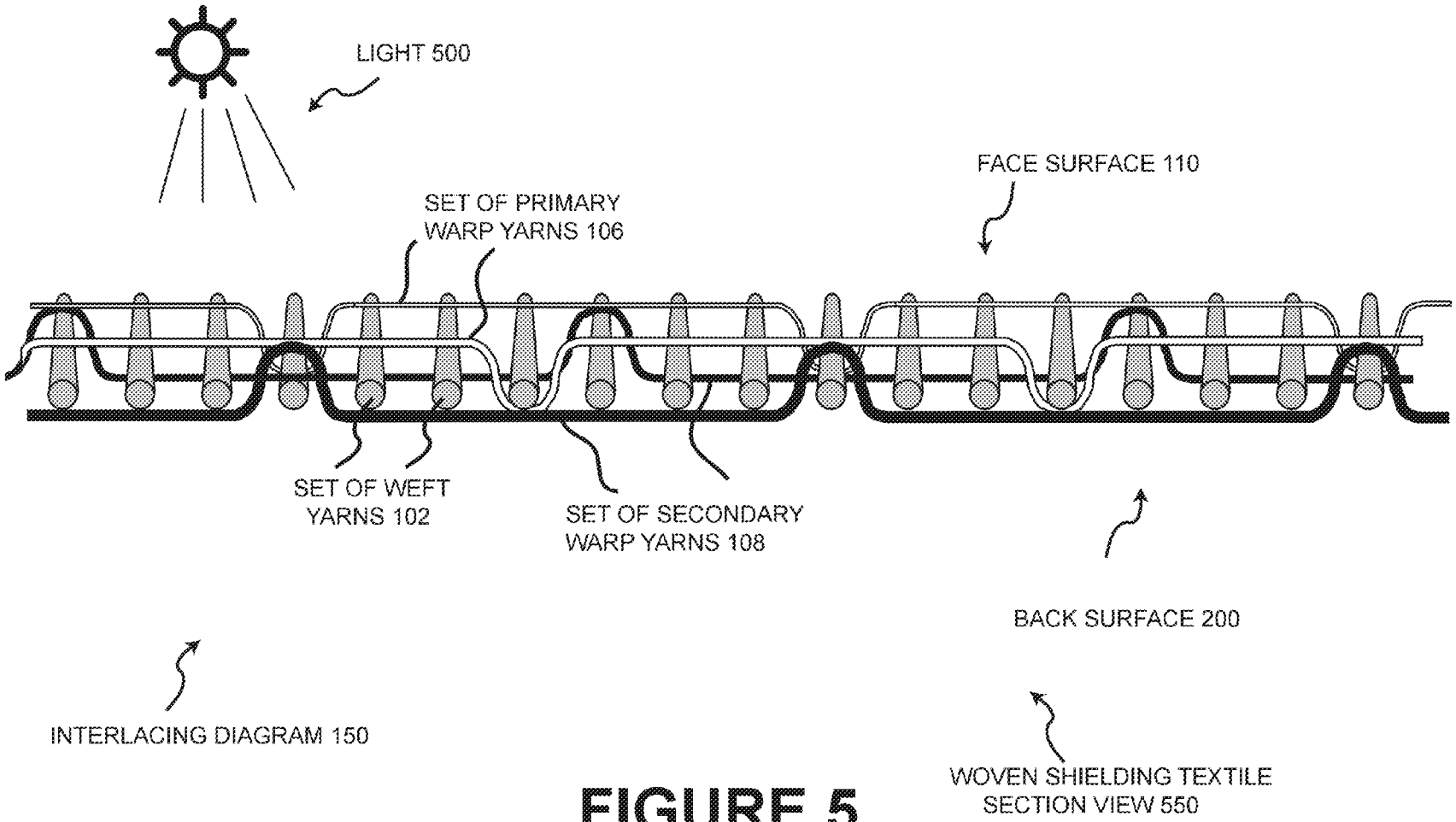
FIG. 5 is a woven shielding textile section view showing the woven shielding textile of FIG. 1 cut across a set of weft yarns, according to one embodiment.

FIG. 5 is a woven shielding textile section view 550 showing the woven shielding textile 100 of FIG. 1 cut across a set of weft yarns 102, according to one embodiment. Particularly, FIG. 5 shows a light 500, in addition to the set of weft yarns 102, the set of primary warp yarns 106, the set of secondary warp yarns 108, and the face surface 110 of FIG. 1, as well as the back surface 200 of FIG. 2, according to one embodiment.

The light 500 may be electromagnetic radiation to which the woven shielding textile 100 may be exposed. In some embodiments, the light 500 may be sunlight 500. In one embodiment, the light 500 may comprise at least one of visible light and ultraviolet light.

As shown, the woven shielding textile 100 is warp-faced, according to one embodiment. The face surface 110 is predominantly composed of the set of primary warp yarns 106, while the back surface 200 is predominantly composed of the set of secondary warp yarns 108.

FIG. 6 is a construction parameter table 650 describing the woven shielding textile 100 of FIG. 1, according to various embodiments. Particularly, FIG. 6 shows a textile weight 600 (e.g. for embodiment Sr.No. 1, "280 GSM"), a warp weight 602 (e.g. for embodiment Sr.No. 1, "100Den"), a weft weight 604 (e.g. for embodiment Sr.No. 1, "300"), a linear density of warp yarns 606 (e.g. for embodiment Sr.No. 1, "308"), and a linear density of weft yarns 608 (e.g. for embodiment Sr.No. 1, "92"), according to one embodiment.

The textile weight 600 may be the weight of a textile, expressed in grams per square meter of the textile. The warp weight 602 may be the weight of a warp yarn, expressed in denier (i.e. the weight, in grams, of 9,000 meters of the yarn). The weft weight 604 may be the weight of a weft yarn, expressed in denier (i.e. the weight, in grams, of 9,000 meters of the yarn). Denier may roughly correlate with the yarn diameter. The linear density of warp yarns 606 may be the number of warp yarns in a woven textile within one inch, measured perpendicular to the warp yarns; it may be expressed in yarns per inch. The linear density of weft yarns 608 may be the number of weft yarns in a woven textile within one inch, measured perpendicular to the weft yarns; it may be expressed in picks per inch. In FIG. 6, "DD" may stand for dope dyed weft, although in one embodiment, the weft may not be dope dyed.

The construction parameter table 650 of FIG. 6 describes the woven shielding textile 100 in a variety of embodiments. The warp of the woven shielding textile 100 has a weight of between 50 denier and 100 denier. The weft of the woven shielding textile 100 has a weight of between 300 denier and 350 denier. The linearly density of the warp yarns in the woven shielding textile 100 is between 250 and 336 yarns per inch. The linear density of the weft yarns of the woven shielding textile 100 is between 57 and 118 picks per inch.

The woven shielding textile 100 may have a weight of between 180 GSM and 280 GSM. To manage a high density of the warp yarns in the final product (e.g., the woven shielding textile) relative the weft yarns, the warp yarns that are to be incorporated into the woven shielding textile 100 may be split into two warp beams that may be operated independently while fed into the looming apparatus. Specifically, the woven shielding textile 100 may be woven using a "double beam" weaving system, with the set of primary warp yarns 106 drawing from a first beam and the set of secondary warp yarns 108 drawn from a second beam. Each of the two warp beams may be synchronized such that a balanced tension in both the face surface 110 and the back surface 200 of the fabric results. Balancing the tension may provide stability of the woven shielding textile 100 during the weaving process. Each of the two warp beams may be driven by a servomotor, and a tension of the warp yarns drawn from each of the beams may be controlled by a load cell. Both of the load cells may be adjusted to further promote the balanced tension of the warp yarns within the looming apparatus.

The plurality of warp yarns 104, which may comprise the majority of the face surface 110 and of the back surface 200 of the woven shielding textile 100, may be over-dyed. In contrast, the set of weft yarns 102 of the woven shielding textile 100 may be made up of a dope dyed yarn. A yarn which is dope dyed may be a synthetic yarn where a polymer that comprises the synthetic yarn (e.g., polyester, etc.), before an extrusion process that forms the synthetic yarn, is mixed with a dye such that the extruded fibers that comprise the synthetic yarn have dye integrated into and therefore substantially permanently associated with them synthetic yarn (e.g., it cannot rub off, etc.). The weft yarn of the woven shielding textile 100, in one embodiment, may be a highly texturized polyester yarn.

In one embodiment, the woven shielding textile 100 may block between 90% and 100% of visible light. In the heavier end of the range of textile weights, the woven shielding textile 100 may block between 98% and 100% of visible light. In one embodiment, the woven shielding textile 100 may block between 90% and 100% of ultraviolet light.

The woven shielding textile 100 may be used to make curtains, drapes, or other window covers. The woven shielding textile 100 may also be used in apparel, and other consumer goods such as jackets, cloaks, umbrellas and/or parasols. The woven shielding textile 100 may be used as garments for animals, e.g., a covering for a horse in an outdoor environment. The woven shielding textile 100 may also be employed in making tents and/or outdoor canvas structures, as may be used in such diverse applications as military deployment or outdoor event tents (e.g., that may be used in a wedding).

A number of embodiments have been described. Although the present embodiments have been described with reference to specific example embodiments, it will be evident that various modifications and changes may be made to these embodiments without departing from the broader spirit and scope of the various embodiments. In addition, the process flows depicted in the figures do not require the particular order shown, or sequential order, to achieve desirable results. In addition, other operations may be provided, or operations may be eliminated, from the described flows, and other components may be added to, or removed from, the described systems. Accordingly, other embodiments are within the scope of the following claims.

What is claimed is:

1. A woven shielding textile comprising:

a set of weft yarns; and a plurality of warp yarns, comprising a set of primary warp yarns and a set of secondary warp yarns;

wherein the set of primary warp yarns and the set of secondary warp yarns are selectively interlaced with the set of weft yarns using a double beam weaving system such that the woven shielding textile is warp-faced, wherein the set of primary warp yarns and the set of secondary warp yarns are selectively interlaced with the set of weft yarns such that a face surface is predominantly composed of the set of primary warp yarns and a back surface is predominantly composed of the set of secondary warp yarns, wherein the set of primary warp yarns and the set of secondary warp yarns are selectively interlaced with the set of weft yarns such that the plurality of warp yarns alternates between the set of primary warp yarns and the set of secondary warp yarns, and wherein the set of primary warp yarns and the set of secondary warp yarns are selectively interlaced with the set of weft yarns such that 90 to 100 percent of a light incident on the woven shielding textile does not pass through.

2. The woven shielding textile of claim 1, wherein the set of primary warp yarns and the set of secondary warp yarns are selectively interlaced with the set of weft yarns such that:

a first warp yarn, belonging to the set of primary warp yarns, floats over six weft yarns before passing under a first weft yarn, a second warp yarn, belonging to the set of secondary warp yarns and adjacent to the first warp yarn, floats under six weft yarns before passing over a second weft yarn, and the first weft yarn and the second weft yarn are separated by three weft yarns.

3. The woven shielding textile of claim 2, wherein the set of primary warp yarns and the set of secondary warp yarns are selectively interlaced with the set of weft yarns such that:

a third warp yarn, belonging to the set of primary warp yarns and adjacent to the second warp yarn, floats over six weft yarns before passing under a third weft yarn, the second weft yarn and the third weft yarn are adjacent, and the third weft yarn is one of the three weft yarns separating the first weft yarn and the second weft yarn.

4. The woven shielding textile of claim 3, wherein a weaving pattern is repeated such that the third weft yarn of a first pattern instance may be the first weft yarn of a second pattern instance.

5. The woven shielding textile of claim 1, wherein:

the woven shielding textile has a weight between 180 GSM and 280 GSM, the plurality of warp yarns has a weight between 50 denier and 100 denier, the set of weft yarns has a weight between 300 denier and 350 denier, the woven shielding textile has a linear density of warp yarns between 250 yarns per inch and 336 yarns per inch, and the woven shielding textile has a linear density of weft yarns between 57 picks per inch and 118 picks per inch.

6. The woven shielding textile of claim 1, wherein the set of weft yarns is dope dyed and the plurality of warp yarns is overdyed.

7. The woven shielding textile of claim 5, wherein:

the set of weft yarns and the plurality of warp yarns are continuous-filament polyester yarns having multiple filaments, and the woven shielding textile does not comprise a light-blocking coating.

8. A woven shielding textile comprising:

a set of weft yarns; and a plurality of warp yarns, comprising a set of primary warp yarns and a set of secondary warp yarns;

wherein the set of primary warp yarns and the set of secondary warp yarns are selectively interlaced with the set of weft yarns such that the woven shielding textile is warp-faced, wherein the set of primary warp yarns and the set of secondary warp yarns are selectively interlaced with the set of weft yarns such that a face surface is predominantly composed of the set of primary warp yarns and a back surface is predominantly composed of the set of secondary warp yarns, wherein the set of primary warp yarns and the set of secondary warp yarns are selectively interlaced with the set of weft yarns such that the plurality of warp yarns alternates between the set of primary warp yarns and the set of secondary warp yarns, and wherein the set of primary warp yarns and the set of secondary warp yarns are selectively interlaced with the set of weft yarns such that 90 to 100 percent of a light incident on the woven shielding textile does not pass through, without relying upon a light-blocking coating.

9. The woven shielding textile of claim 8, wherein the set of primary warp yarns and the set of secondary warp yarns are selectively interlaced with the set of weft yarns such that:

a first warp yarn, belonging to the set of primary warp yarns, floats over six weft yarns before passing under a first weft yarn, a second warp yarn, belonging to the set of secondary warp yarns and adjacent to the first warp yarn, floats under six weft yarns before passing over a second weft yarn, and the first weft yarn and the second weft yarn are separated by three weft yarns.

10. The woven shielding textile of claim 9, wherein the set of primary warp yarns and the set of secondary warp yarns are selectively interlaced with the set of weft yarns such that:

a third warp yarn, belonging to the set of primary warp yarns and adjacent to the second warp yarn, floats over six weft yarns before passing under a third weft yarn, the second weft yarn and the third weft yarn are adjacent, and the third weft yarn is one of the three weft yarns separating the first weft yarn and the second weft yarn.

11. The woven shielding textile of claim 10, wherein a weaving pattern is repeated such that the third weft yarn of a first pattern instance may be the first weft yarn of a second pattern instance.

12. The woven shielding textile of claim 8, wherein:

the woven shielding textile has a weight between 180 GSM and 280 GSM, the plurality of warp yarns has a weight between 50 denier and 100 denier, the set of weft yarns has a weight between 300 denier and 350 denier, the woven shielding textile has a linear density of warp yarns between 250 yarns per inch and 336 yarns per inch, and the woven shielding textile has a linear density of weft yarns between 57 picks per inch and 118 picks per inch.

13. The woven shielding textile of claim 8, wherein the set of weft yarns is dope dyed and the plurality of warp yarns is overdyed.

14. The woven shielding textile of claim 12, wherein the set of weft yarns and the plurality of warp yarns are continuous-filament polyester yarns having multiple filaments.

15. A woven shielding textile comprising:

a set of weft yarns; and a plurality of warp yarns, comprising a set of primary warp yarns and a set of secondary warp yarns;

wherein the set of primary warp yarns and the set of secondary warp yarns are selectively interlaced with the set of weft yarns using a double beam weaving system such that the woven shielding textile is warp-faced, wherein the set of primary warp yarns and the set of secondary warp yarns are selectively interlaced with the set of weft yarns such that a face surface is predominantly composed of the set of primary warp yarns and a back surface is predominantly composed of the set of secondary warp yarns, wherein the set of primary warp yarns and the set of secondary warp yarns are selectively interlaced with the set of weft yarns such that the plurality of warp yarns alternates between the set of primary warp yarns and the set of secondary warp yarns, wherein the set of primary warp yarns and the set of secondary warp yarns are selectively interlaced with the set of weft yarns such that 90 to 100 percent of a light incident on the woven shielding textile does not pass through, wherein the set of primary warp yarns and the set of secondary warp yarns are selectively interlaced with the set of weft yarns such that a first warp yarn, belonging to the set of primary warp yarns, floats over six weft yarns before passing under a first weft yarn, wherein the set of primary warp yarns and the set of secondary warp yarns are selectively interlaced with the set of weft yarns such that a second warp yarn, belonging to the set of secondary warp yarns and adjacent to the first warp yarn, floats under six weft yarns before passing over a second weft yarn, wherein the set of primary warp yarns and the set of secondary warp yarns are selectively interlaced with the set of weft yarns such that the first weft yarn and the second weft yarn are separated by three weft yarns, wherein the set of primary warp yarns and the set of secondary warp yarns are selectively interlaced with the set of weft yarns such that a third warp yarn, belonging to the set of primary warp yarns and adjacent to the second warp yarn, floats over six weft yarns before passing under a third weft yarn, wherein the set of primary warp yarns and the set of secondary warp yarns are selectively interlaced with the set of weft yarns such that the second weft yarn and the third weft yarn are adjacent, and wherein the set of primary warp yarns and the set of secondary warp yarns are selectively interlaced with the set of weft yarns such that the third weft yarn is one of the three weft yarns separating the first weft yarn and the second weft yarn.

16. The woven shielding textile of claim 15, wherein a weaving pattern is repeated such that the third weft yarn of a first pattern instance may be the first weft yarn of a second pattern instance.

17. The woven shielding textile of claim 16, wherein the woven shielding textile has a weight between 180 GSM and 280 GSM.

18. The woven shielding textile of claim 16, wherein:

the plurality of warp yarns has a weight between 50 denier and 100 denier, the set of weft yarns has a weight between 300 denier and 350 denier, the woven shielding textile has a linear density of warp yarns between 250 yarns per inch and 336 yarns per inch, and the woven shielding textile has a linear density of weft yarns between 57 picks per inch and 118 picks per inch.

19. The woven shielding textile of claim 15, wherein the set of weft yarns is dope dyed and the plurality of warp yarns is overdyed.

20. The woven shielding textile of claim 16, wherein:

the set of weft yarns and the plurality of warp yarns are continuous-filament polyester yarns having multiple filaments, and the woven shielding textile does not comprise a light-blocking coating.

* * * * *